US005078198A

United States Patent [19]

Tedeschi

[11] Patent Number: 5,078,198

[45] Date of Patent: Jan. 7, 1992

[54] TAKE-UP ROLLER FOR CURTAINS OF THE ROLL-UP TYPE

[75] Inventor: Giovanni Tedeschi, Funo di Argelato, Italy

[73] Assignee: Sunproject S.r.l., Bologna, Italy

[21] Appl. No.: 519,899

[22] Filed: May 7, 1990

[30] Foreign Application Priority Data

May 12, 1989 [IT] Italy ..... 3463 A/89

[51] Int. Cl.[5] ..... E06B 9/20

[52] U.S. Cl. ..... 160/315; 160/301

[58] Field of Search ..... 160/313, 315, 318, 294, 160/300, 323.1, 326, 301, 305, 23.1

[56] References Cited

U.S. PATENT DOCUMENTS

| | | | |
|---|---|---|---|
| 873,438 | 12/1907 | John | 160/294 X |
| 1,416,071 | 5/1922 | Smurr . | |
| 2,350,286 | 5/1944 | Michelman | 160/315 X |
| 4,427,050 | 1/1984 | Toppen | 160/315 |
| 4,429,729 | 2/1984 | Winslow | 160/315 |
| 4,523,620 | 6/1985 | Mortellite | 160/315 |
| 4,681,279 | 7/1987 | Nakamura | 160/294 X |

FOREIGN PATENT DOCUMENTS

| | | | |
|---|---|---|---|
| 2648525 | 10/1976 | Fed. Rep. of Germany . | |
| 2308777 | 4/1976 | France . | |
| 648033 | 12/1950 | United Kingdom | 160/294 |

*Primary Examiner*—David M. Purol

*Attorney, Agent, or Firm*—Darby & Darby

[57] ABSTRACT

A roller on which a curtain is rolled up has its respective ends closed by a washer and by a cap having two opposed recesses one inside and the other outside the roller. A first support in the outer recess supports one end of a threaded rod passing inside the roller and inserted at its other end, in a second support fastened to the washer. The threaded rod crosses two opposed bodies one of which is fixed and the other is movable, by virtue of its coupling with the threaded rod and the rod's axial rotation. Between the two bodies, a helical spring has its ends fastened to the same bodies, so that, the rotation of the roller causes the rotation of the movable body, which twists the spring, but at the same time moves along the threaded rod, thereby changing the longitudinal space available to the spring.

8 Claims, 1 Drawing Sheet

TAKE-UP ROLLER FOR CURTAINS OF THE ROLL-UP TYPE

BACKGROUND OF THE INVENTION

This invention is in the technical field concerning the construction of systems having basically a screening function, to be applied to windows, such as, e.g., the well known vertically-sliding curtains, which can be unwound and rewound on a roller.

DESCRIPTION OF THE PRIOR ART

Known systems having basically a screening function, to be applied to windows, such as, e.g., well known vertically-sliding curtains, comprise a roller, on which the curtains are wound, (or the nets in the case of mosquito-nets). The roller is supported horizontally by suitable means inside a corresponding housing, called a box, placed above the window, or close to the windows upper edge.

The free end of the curtain comes out of the box through a downward slit. In this way, by pulling the curtain downwards, it is possible to unwind it from the roller.

Elastic means, generally consisting of a helical spring placed inside the roller, have the function to cause the curtain to be rewound on the roller, while other means, of known type, allow the curtain to be steadily positioned in the desired level.

In a first known device, one end of a helical spring is fastened to the roller, supported horizontally, said helical spring being housed inside the roller and fastened the other end of the spring is fastened an element which is fixed with respect to the roller. The fixed element may be rotated, to regulate the preloading of the spring and to provide for the complete rewinding of the curtain. When unwinding the curtain, the spring is subjected to a torsion which increases its number of turns. As a result, the spring is undulated, so, as it has been noticed, the effect of the torsional action of the roller is not evenly distributed on the whole length of the spring, but affects some sectors of the spring in particular, which sectors are therefore more stressed than others.

A second known device, in order to avoid undulation of spring and the uneven distribution of torsional stress, provides for division of the spring into many equal sectors, through a series of narrowings of the helicoid forming the spring.

The narrowings, i.e. those zones where the spring is wound in a reduced diameter which remains adhering to a shaft passing through the same spring, achieve the purpose of keeping the spring basically rectilinear, and of distributing the effect of torsion among the various spring sectors, so improving the distribution of stress. However, to realize this latter device, it is necessary to make the spring in a unprofitable way, and with a certain complexity, as described above; furthermore, the problem concerning the distribution of effects of torsional stress is not solved completely and satisfactorily.

SUMMARY OF THE INVENTION

The object of the invention is to provide a device which exploits, in an optimal way, the action of energy accumulation and the elastic reaction of the spring, thereby allowing the spring to remain basically rectilinear without needing special and complex construction forms, and proposes a solution which is both functional and easy to carry out.

The above-mentioned object is achieved through an improved device with take-up roller for curtains of the roll-up type, comprising a roller having the purpose to have a curtain wound thereon. The device also comprises means for closing the heads or ends of said roller consisting of a cover, bearing a pin partially and coaxially inserted inside the cover as well as extended outwards a cap, this latter being provided, on its opposite ends, with, two recesses, one of which is inside the roller. The inside recess is provided with a number of ribs extending longitudinally. The other recess is outside the roller, and characterized by a raised circular lip defining a collar. Two support means, respectively first and second, are fastened in a revolving mount, the first one to said cap, coupling with said collar, and the second one to a centering washer, placed inside said roller, close to its head closed by said cover with a threaded rod passing through said roller being fastened to said support means. Two, one fixed and one movable respectively, characterized by an axial through hole, through which said threaded rod passes, with said fixed body locked at the same rod and with said movable body coupling with the same rod and with said cap, thus turning out to be subject to longitudinal horizontal translations according to opposite directions as a consequence of the rotation in either sense of said rod following the corresponding rotation of said roller. A spring is inserted longitudinally into said roller and has its ends respectively fastened to said fixed and movable bodies, with said threaded rod passing through the inside of said spring. Means are also provided for temporarily stopping the rotation of said roller.

BRIEF DESCRIPTION OF THE DRAWINGS

The features of this invention, not apparent from what has been said above, are pointed out below, with particular reference to the drawings enclosed herewith, where.

DESCRIPTION OF THE PREFERRED EMBODIMENT

Figures 1, 2, 3, 4:
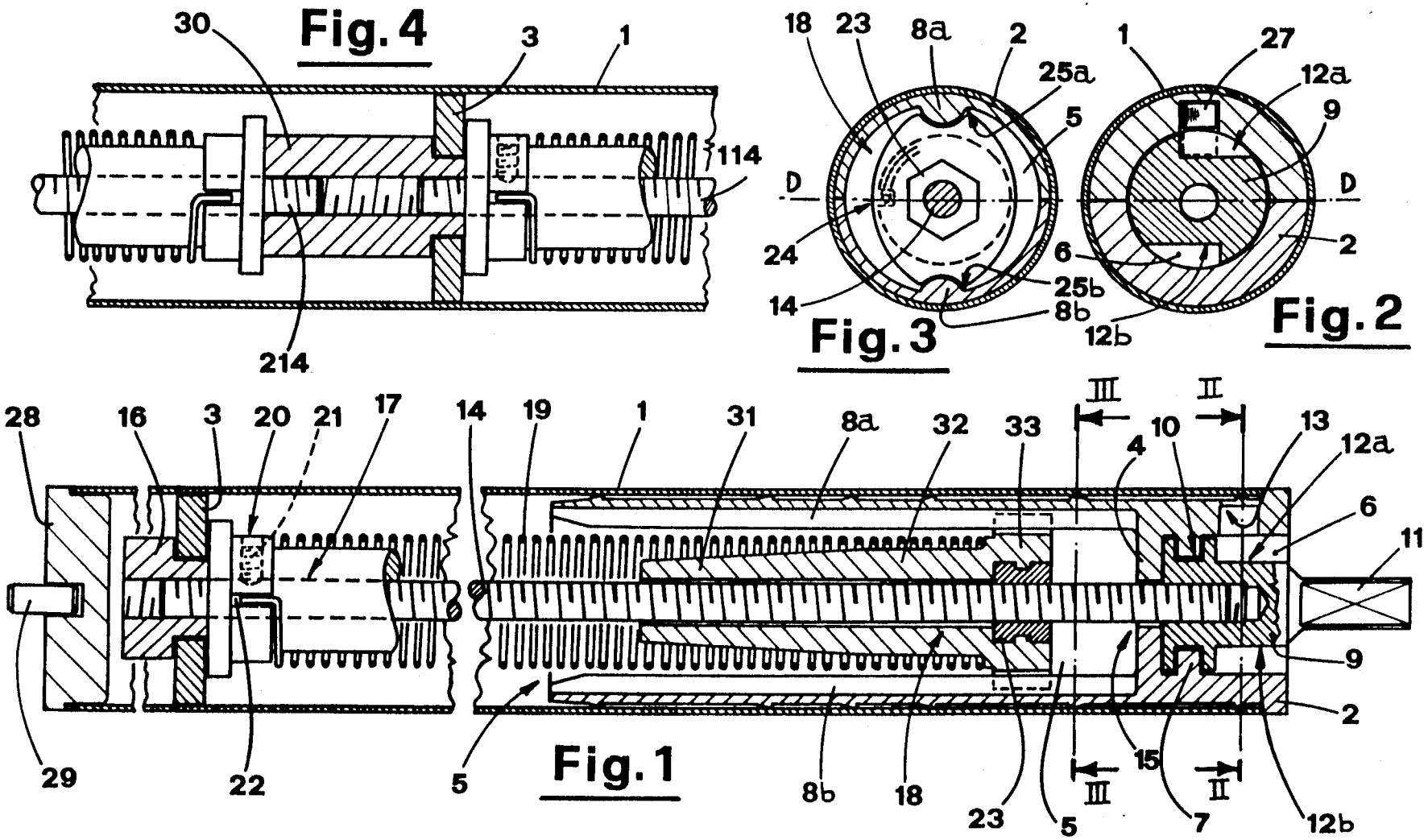
FIG. 1 shows a cutaway view of the device in accordance with the invention, according to a plane of longitudinal symmetry.
FIGS. 2 and 3 show the same device as FIG. 1, respectively seen according to the section lines II—II and III—III of FIG. 1.
FIG. 4 shows a detail of the device in FIG. 1 featuring a constructional variation.

With reference to the above-mentioned drawings, the roller has the purpose to receive a curtain, (or a mosquito-net or the like), wound on itself.

The roller 1, which is hollow, is closed at one of its heads or ends by a cap 2 which is inserted into said roller for a determined length.

The two opposed sides of the cap 2 are provided with two recesses 5 and 6 respectively inside and outside the roller 1, the outer one featuring, close to the bottom, a raised lip defining a collar 7, which is mentioned below. The inner recess 5 includes two longitudinal ribs, 8*a* and 8*b*, which are also mentioned below. The wall 4 dividing the two recesses has a through hole 15 in the central position.

Inside the outer recess 6, a first support means 9 is placed, basically having a cylindrical shape, provided with a groove 10 close to its inner end, and complementary with the collar 7 with which it engages itself. In order to allow insertion of the first support means 9 into the recess 6, with coupling of the groove 10 and the collar 7, the cap 2 is made in two symmetrical parts, which can be divided according to the section line D—D of FIG. 3.

The two parts of the cap 2 are coupled together, with the first support means 9 already positioned between them, before the cap 2 is inserted into the roller. The end of the first support means 9, which has a diameter less than that diameter of the recess 6, extends to define a tang 11 having the purpose of allowing the roller to be supported, in cooperation with a pin 29, which is partially and coaxially inserted in a cover 28 closing the other end of the roller 1, opposed to the cap 2. A second purpose of the tang 11 is clearly described below.

On the circumferential surface of the first support means 9, two flat surfaces, or indents, 12*a* and 12*b*, are provided, placed in diametrically opposed positions on the part of the first support means 9 included between the end of the roller 1 and the collar 7.

In the surface of the recess 6, corresponding with the flat surfaces 12*a* and 12*b*, a niche 13 is provided, into which a block 27 having a parallelepipedal shape is inserted.

With reference to FIG. 2, if the roller 2 is rotated in the direction S for unwinding the curtain, then the roller has no obstacle to the rotation relative to the first support means 9, which on the contrary is fixed, owing to the fact that the flat surfaces 12*a, b*, acting as inclined planes, push the block 27 into the niche 13, every time the latter passes close to one of them. On the contrary, the roller 2 is prevented from rotating in the opposite curtain-rewinding direction R, since the block remains striking against the two square faces of the flat surfaces, which are in the upper position, and the lower edge of the niche 13. The relative rotating movements between the first support means 9 and the cap-roller assembly is thereby stopped. However, if the rotation of the roller in the rewinding direction R is fast enough, the block 27 cannot come out of the niche 13 and stop the roller, due to the combined effect of the centrifugal force acting on it, and the block inertia. The inner end of the first support means 9 is provided with a blind hole, inside which the end of a threaded rod 14 is inserted and fastened. The rod extends through the hole 15 and along the roller be to be with its other end inserted into a second support means 16, supported, coaxially to the roller, by a centering washer 3 fastened to the end of the roller 1, for closure of the same.

The threaded rod 14 extends through the axial through holes of two opposed bodies 17 and 18, respectively fixed and movable, having the purpose of supporting a helical-type spring 19.

In FIG. 1, only the movable body 18 is shown completely, while, as far as the fixed body 17 is concerned, only the part which is different from the movable body 18 is shown. In substance, the two bodies 17 and 18 may be ideally subdivided into three coaxial sections, i.e. an initial truncated-cone section 31, a central cylindrical section 32 and a terminal cylindrical section 33, having a greater diameter than the central one. The initial truncated-cone section 31 and central cylindrical section 32 of the two bodies, have the same shape for both of them, and are inserted into respective end parts of the spring 19.

The ends of the spring strike against the terminal cylindrical sections 33 of the two bodies 17 and 18, while the initial truncated-cone sections 31 remain facing each other.

The terminal cylindrical section 33 of the fixed body 17 is provided with a threaded radial hole 20. Inside the hole 20, a dowel 21 is inserted, whose clamping against the threaded rod 14 causes the fixed body 17 to be locked to the latter.

On the circumferential surface of the terminal cylindrical section 33, a groove 22 is made, extending longitudinally, inside which the end, bent at right angles, of the spring 19 is inserted, which is therefore prevented from rotating with respect to the body 17 and hence to the threaded rod 14. In the terminal cylindrical section 33 of the movable body 18, a threaded insert 23 is sunk, coaxial with the hole of the same movable body 18. The insert 23 remains engaged with the threaded rod 14. The terminal part of the movable body 18 is shaped according to an ellipse, with the ends corresponding with the longer axis provided with two grooves 25*a* and 25*b* extending parallel to the center line of the same body, and it is laterally provided with a groove 24 extending longitudinally, inside which the other end, bent at right angles, of the spring 19 is inserted, so that said spring remains engaged with the same movable body.

Then the movable body 18 is positioned along the threaded rod 14 in such a way that it remains inserted inside the inner recess 5 of the cap 2, with the grooves 25*a* and 25*b* respectively coupling with the ribs 8*a* and 8*b*. As a result, when the curtain is unwound, the rotation of the roller 1 is transmitted by the cap 2 to the movable body 18 which, by virtue of the threaded insert 23 acting on the rod 14, is pushed towards the inside of the recess 5, so increasing, in longitudinal sense, the space available to the spring 19. In that way, any undulation of the spring is avoided, and the effects of torsion are evenly distributed on the whole length of the same spring.

When the curtain is released, the elastic reaction of the spring brings about the rotation of the roller 1 in the opposite sense as to the previous one, the rewinding of the curtain on the roller 1 and the movable body 18 being brought back to the initial position along the threaded rod 14. When the tang 11 is rotated in either sense, the threaded rod 14 brings about a rotation of the fixed body 17 in the same direction, respectively increasing or reducing the initial torsion of the spring in order to regulate its pre-loading.

With the aim of extending the length of roll-up curtains, thus of the roller on which the curtain is rolled up, the roller length may be doubled, by juxtaposing two rollers with the two tangs 11 turned outwards and with the second support means 16 replaced by a single junction means 30, as illustrated in FIG. 4. The two threaded rods 114 and 214 are inserted, on both sides, in the axial hole which crosses the single junction means 30. Obviously, the extension of the spring of the second roller shall be exactly contrary to the spring of the first roller.

It is clear that, to construct the device being the subject of this invention, it is not required to make a spring having a special shape, but, above all, it is evident that the effects of the torsional action are distributed in an optimal way along the whole length of the spring, which always remains rectilinear, so that the problem mentioned in the introduction is completely and satisfactorily solved. The device being presented is able to exploit the action of energy accumulation and the elastic reaction of the spring in an optimal way, so providing a solution which turns out to be functional and easy to carry out.

It is understood that the above has been described as an example and not as a limitation. Therefore any possible variation of constructional details (for instance, the movable body 18 and the threaded insert 23 may be made in a single body) is understood to be covered by the patent hereby applied for, concerning this invention, as described above and according to the following claims.

What is claimed is:

1. A take-up roller device for curtains of the roll-up type, comprising:

a circular cross section roller of extended length for receiving a curtain wound thereon, said roller having a first end and a second end;

a generally-circular cover fixed to said roller for closing said first roller end, said cover having a coaxial pin extended away from said roller;

a generally-circular cap fixed to said roller for closing said second roller end, said cap having a first recess including at least one rib extended longitudinally within said roller, said cap having a second generally-cylindrical recess extending inward from said second roller end, said recesses being separated by a partition having a central opening therethrough, and a lip radially extended from a cylindrical wall of said second recess to form a collar;

a washer fixed within said roller and having a central opening therethrough;

a first support within said second recess having notch means for rotatably coupling with said cap collar;

a second support rotatably mounted in said central opening of said washer;

a threaded rod concentrically positioned in said roller and extended through said central opening in said cap partition, a first end of said rod being fixed to said first support, and a second end of said rod being fixed to said second support;

a stationary body within said roller adjacent said washer and fixed relative to said rod, said stationary body extending toward said cap;

a movable body within said first recess of said cap, said movable body extending toward said cover and having means for engaging said at least one rib of said first recess, said engagement permitting motion of said movable body lengthwise in said roller and causing rotation of said movable body when said roller rotates, said movable body being threadably coupled to said rod and moving longitudinally within said roller in one direction when said roller is rotated in a first direction and moving within said roller in the opposite direction when said roller is rotated in its opposite direction;

a torsion spring surrounding said rod and extending between said fixed body and said movable body, opposite ends of said spring respectively being engaged with said fixed body and said movable body; and means for temporarily retaining said roller from rotating.

2. A roller device as in claim 1, wherein said first support is cylindrical and includes a circumferential groove complimentarily coupled with said collar, said first support further including a tang extending coaxially from said second recess, and a blind axial hole, said first end of said threaded rod being received in said blind hole.

3. A roller device as in claim 1, wherein said second support is cylindrical and includes a circumferential groove complimentarily coupled with said washer, said second support having an axial through hole, the second end of said threaded rod being inserted into said through hole.

4. A roller device as in claim 1, said stationary body and movable body each includes a truncated cone-shaped section, a central section being a cylinder, and a third section having a diameter larger than the diameter of said central section, said central and third sections of said bodies being inserted in respective ends of said spring, said terminal sections including grooves extending parallel to the length of said roller, respective ends of said spring being fixed in said grooves.

5. A roller device as in claim 4, wherein said stationary body includes a threaded radial hole in said terminal section, and further comprising a dowel inserted in said threaded radial hole, said stationary body being locked to said threaded rods by means of said dowel.

6. A roller device as in claim 4, and further comprising a threaded insert coaxially seated in said terminal section of said movable body, said threaded rod engaging said threaded insert.

7. A roller device as in claim 1, wherein said means for temporarily retaining said roller from rotating include a pair of flat surfaces on said first support, said flat surfaces being located between said collar and said tang, a surface of said second recess including a niche aligned with said flat surfaces, and further comprising a block of parallelepipedal shape, said block being inserted into said notch and engaging said flat surfaces when said roller is stationary.

8. A roller device as in claim 1, wherein said partition includes an axial hole, said threaded rod passing through said hole.

* * * * *